United States Patent [19]

Meyer

[11] 4,121,311

[45] Oct. 24, 1978

[54] PROCESS AND APPARATUS FOR THE TREATMENT OF LENGTHS OF TEXTILE MATERIAL

[76] Inventor: Arnfried Meyer, Würzburger Strasse, 7100 Heilbronn, Germany

[21] Appl. No.: 729,986

[22] Filed: Oct. 6, 1976

[30] Foreign Application Priority Data

Oct. 6, 1975 [AT] Austria ..... 7617/75

[51] Int. Cl.[2] ..... D06B 5/04

[52] U.S. Cl. ..... 8/149.3; 8/151; 8/152; 26/18.5; 28/281; 34/34; 34/191; 68/5 D; 68/18 F; 68/20

[58] Field of Search ..... 8/149.1, 149.2, 149.3, 8/151, 152, 151.2; 68/5 D, 5 E, 18 F, 20, 177, 205 R; 26/18.5; 28/281; 34/34, 191

[56] References Cited

U.S. PATENT DOCUMENTS 3,757,548 9/1973 Collinge ..... 68/205 R

FOREIGN PATENT DOCUMENTS 479,804 12/1951 Canada ..... 68/5 D

*Primary Examiner*—Philip R. Coe
*Attorney, Agent, or Firm*—Craig & Antonelli

[57] ABSTRACT

Process and apparatus for the continuous, tensionless treatment of textile material lengths and similar web-shaped flat materials wherein the material is conveyed in gathered form to at least one treatment zone of a material treating unit. A fluid stream impinges intermittently from below upon the length of material approximately at right angles to the conveying direction thereby straightening and compressing the material by an alternating lifting and falling of the material. An air permeable conveyor belt may be employed to convey the length of material through the treating units or a number of spaced individual rollers may be provided in the treating unit with the material forming a loop between adjacent rollers which loop is acted upon by the stream of fluid. A sensor arrangement is provided for determining and controlling the length of the loop so as to maintain such length within predetermined limits. The air stream is directed against the material by way of at least one nozzle associated with one or more treatment zones in the treatment unit. The nozzle may be pivotally mounted so as to cooperate with adjacent treating zones or closing elements may be provided for closing one or more nozzles thereby intermittently affecting the respective treatment zones.

38 Claims, 10 Drawing Figures

PROCESS AND APPARATUS FOR THE TREATMENT OF LENGTHS OF TEXTILE MATERIAL

The present invention relates to a process an apparatus for the continuous, tensionless treatment, such as the drying, shrinking, finishing, or the like, of textile material lengths or similar web-shaped flat material, wherein flowing air impinges on a length of material conveyed in gathered form.

In accordance with German Pat. No. 964,948, a process and apparatus for the tensionless drying of lengths of textile material has been known wherein the length of material is suspended in loop form on transverse elements moving in a conveying direction. With the lower ends of the loops of material being arranged on a further, air-permeable conveyor belt moving at the same speed as the transverse elements. Compressed air flows through nozzles arranged below and above the length of material onto and into the loops of material so that the longitudinal area of the length of material lying on the conveyor belt is somewhat lifted. Since the length of material itself does not move with respect to the transverse elements and the conveyor belt, each portion of the length of material remains at the location occupied during the introduction and suspension on the transverse elements. Therefore, the drying step is carried out practically in the rest position of the length of material. By a periodic upward and downward movement of the conveyor belt, the length of the loop can additionally be varied without the length of material executing its own movement in the conveying direction. Thus, in accordance with this known construction the same sections of the length of material always remain in a flat and a pleated or gathered form, whereby a varying effect occurs in certain zones of the length of material, for example a varying drying effect, so that one area of the material has already been dried while another area is still moist. Thus, the web of material can assume a differing appearance and also other undesirable properties over the individual sections of the material. Therefore this conventional process and apparatus are strictly limited in application and are, above all, unsuitable for the treatment of lengths of material.

Consequently, it is an object of the invention to provide a process and apparatus suitable for the continuous treatment, such as drying and final processing, i.e. shrinking, finishing, or the like, wherein the length of material can be treated without tension and in a uniform manner.

This object is attained by the present invention in that the length of material passes through at least one treatment zone in a treatment unit, wherein the stream of air impinges intermittently from below on the length of material approximately perpendicularly to the conveying direction of the material, whereby the length of material is straightened or stretched and buckled or compressed by an alternating rising and falling of the material.

According to a further feature of the present invention, tensile stresses in the length of material are avoided by providing that, due to the gathering in the conveying direction in the area of the treatment zone, there is constantly at least one longitudinal section of the length of material available which corresponds to the lifting height caused by an impinging stream of air.

In accordance with another feature of the present invention, an apparatus is provided which includes a conveying means for the gathered transportation of the length of material through the treatment unit with nozzle means, connected to a source of compressed air and intermittently blowing an air stream onto the length of material in the treatment zone, being mounted beneath the length of material and arranged so as to extend at right angles to the conveying direction of the conveying means.

In accordance with a further feature of the invention, an accurate guidance of the length of material in the treatment zone of the treatment unit is attained by limiting the treatment zone in the conveying direction above the nozzle means by the provison of partitions disposed at right angles to the conveying direction arranged at a spacing from each other with the vertical dimension of the partitions corresponding to the lifting height of the length of material.

The advantages attained by the present invention Whereby particularly in that the length of material passes through one or more treatment zones wherein the material is exposed to air jets and is set into motion so that the length of material is constantly lifted and immediately thereafter falls back into its original position, during which lifting and falling process the length of material is alternatingly straightened and buckled. Thus, the length of material executes an optimum motion in each of its longitudinal regions without entering into a deleterious tensioned condition, i.e. the length of material is moved practically without tension. Whereby, the entire length of material is uniformly treated, i.e. dried by heating and/or subjected to a finishing process.

Another advantage of the present invention resides in the fact that the entire treatment is enhanced by the completely free motion cycle, which cycle is a prerequisite for the alteration of the fiber shape, for example, in order to obtain, from a straight fiber, a crimped fiber, or from a flat-lying loop a standing loop. Since the treatment media, such as air or other media amenable to spraying, such as steam, for example, come into intensive contact with the material, advantageously the desired effect occurs to a pronounced extent, as well as within a relatively brief period of time. Consequently, the process and apparatus of the present invention can be utilized with great versatility so that it is possible not only to obtain a plurality of different types of material but also varying effects on specific lengths of material.

These and other objects, features, and advantages of the present invention will become more apparent from the following description when taken in connection with the accompanying drawing which shows, for the purposes of illustration only, several embodiments in accordance with the present invention, and wherein.

Figure 1:
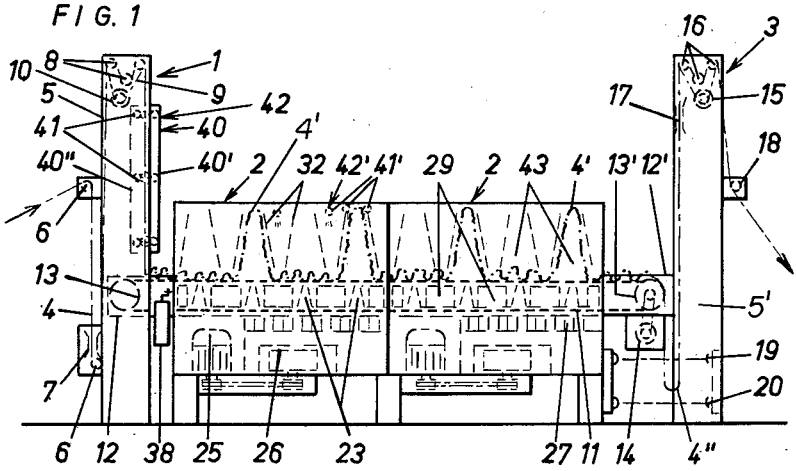
FIG. 1 is a lateral view of a textile treating apparatus in accordance with the present invention.
Figure 2:
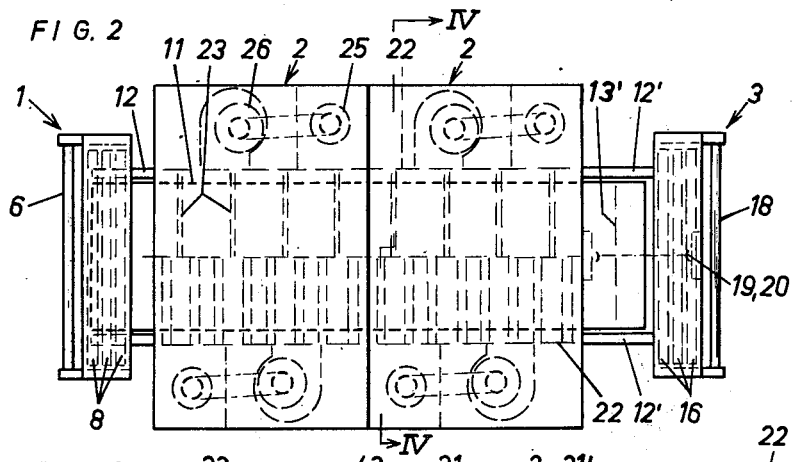
FIG. 2 is a top view of the apparatus of FIG. 1.

Referring now to the drawings, wherein like reference numerals are used throughout the various views to designate like parts and, more particularly, to FIG. 1, according to this figure, apparatus for the continuous and tensionless treatment of lengths of textile material or similar, web-shaped flat material is provided which consists of several units combined in series in a material conveying direction with an inlet unit generally designated by the reference numeral 1 being arranged at a feed end for receiving a length of material 4 to one or more treatment units generally designated by the reference numeral 2 and an outlet unit generally designated by the reference numeral 3 at the discharge end of the apparatus for delivering the treated material. A length of material 4 extends through the entire apparatus. The inlet unit 1 includes an upright narrow frame 5 supporting rollers 6 and a spreader 7 of a conventional type for guiding the web of material 4 therein and for retaining the material at its full width without folds. In the upper zone of frame 5, three drive rollers 8 are arranged offset with respect to one another and are driven through a chain 9 or the like by a motor 10 so that the length of material 4 placed about the drive rollers 8 is moved from the left to the right in the conveying direction. From the last drive roller 8, the length of material 4 moves vertically downwardly and is placed in gathered form on a rotating conveying means fashioned as an endless conveyor belt 11 (FIGS. 1–4).

The conveyor belt 11 extends from the inlet unit 1 through all of the treatment units 2 arranged subsequently and discharges in the area of the outlet unit 3. A guide roller 13 is mounted to horizontal carrier arms or brackets 12 arranged upstream of the inlet side of the first treatment unit 2. The conveyor belt 11 is disposed around guide roller 13 such that the belt 11 projects into the frame 5 of the inlet unit 1 beneath the downwardly moving length of material fed from the driver rollers 8. Carrier arms 12′ corresponding to the carrier arms 12 are arranged on a downstream or backside of the last treatment unit 2 with a guide roller 13′, being mounted between the carrier arms 12, being driven by, preferably, an infinitely variable motor 14, so that the conveyor belt 11 rotates in a clockwise direction.

The outlet unit follows or is arranged upstream of the carrier arms 12′ and is constructed similar to the inlet unit. Specifically, the inlet unit includes a frame 5′ having arranged in an upper region thereof three rollers 16 driven by a motor 15 with the rollers functioning to convey the material 4 from the discharge end of the conveyor belt 11 out of the apparatus. A spreader device 17 of conventional construction, is arranged upstream of the rollers 16 for retaining the material 4 at full width with a guide roller 18 being disposed downstream of the rollers 16. As shown in FIG. 1, the length of the material 4 forms a hanging loop 4″ between the discharge end of the conveyor belt 11 and the rollers 16. The length of the hanging loop 4″ is scanned by an upper light barrier 19 and a lower light barrier 20. Both light barriers 19 and 20 are connected to the motor 15 for control purposes. In the illustrated normal operating position, the material 4 covers the upper light barrier 19 and with the lower light barrier being closed, the speed of the motor 15 is increased if also the light barrier 20 is interrupted and, conversely, is reduced if the light barrier 19 is closed.

The conveyor belt 11 runs laterally in each treatment unit 2 in longitudinal guides 21 provided at sidewalls 22 and is made so as to be air-permeable and of a temperature-resistant material. Preferably, in each treatment unit 2, as shown in FIGS. 1–4, for examples, four nozzles 23 extend at right angles to the conveying direction of the material 4. As shown most clearly in FIG. 3, the nozzles 23 are provided between an upper belt face 11′ moving in the conveying direction and the lower returning belt face 11″ in each treatment unit with the respective nozzles 23 terminating at the bottom in a pressure chamber 24 which has arranged therein fans 26 disposed on both sides of the conveyor belt 11 outside of the sidewalls 22 with each of the fans 26 being driven respectively by a motor 25. The fans 26 carry air which can be warmed by respectively one heating system 27, (FIGS. 1, 4) connected in front thereof with a lint filter 28 on top whereby the temperature of the jet of air from the nozzles 23 is preferably controllable. The jet of air from the nozzles 23 is ejected in the upward direction and is sucked by outlet openings 29 in the sidewalls 22 into respectively one closed suction chamber 30 (FIG. 4) which is accessible for servicing purposes through flaps, doors, or the like (not shown). The lint filter 28 is provided in the bottom panel of the suction chambers 30 whereby the air is discharged from the suction chambers 30 toward the bottom through the respective lint filters 28 and heating system 27 and drawn by the respective fans 26 into the pressure chamber thereby forming a closed cycle.

While the outlet openings 29 are illustrated as being arranged at the level of and between the nozzles 23, such openings can be arranged above the top face 11′ of the conveyor belt 11. In the illustrated arrangement of FIG. 4, the sidewalls of adjacent nozzles 23 which face each other form a downwardly closed chamber 31 with the outlet openings 29 terminating in the chamber 31 on both sides thereof. A transverse slot 31′ is provided at the top of each chamber 31 to allow the returning air to enter therein.

Partitions 32 are arranged above the conveyor belt 11 and extend in pairs and at right angles to the conveying direction of the material 4 with the partitions 32 being attached to the sidewalls 22. A spacing $S_1$ (FIG. 3) is provided between the conveyor belt 11 and a bottom edge of the partitions 32 for the passage of material between the conveyor belt 11 and the partitions with a spacing $S_2$ (FIG. 4) being provided between the top edge of the partitions 32 and the ceiling 33 of the treatment unit 2 for air compensating purposes. Preferably, the partitions 32 are arranged to converge above the nozzle 23 in the upward direction, so that upwardly narrowing treatment zones (FIG. 1) are produced above the nozzles 23.

Figure 3:
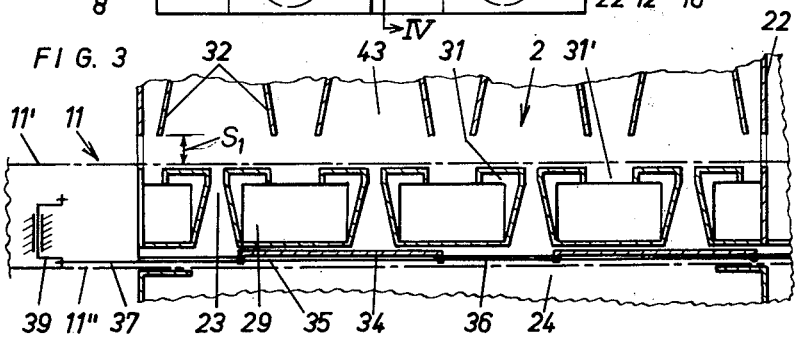
FIG. 3 is an enlarged longitudinal partial sectional view of the apparatus of FIG. 1.
Figure 4:
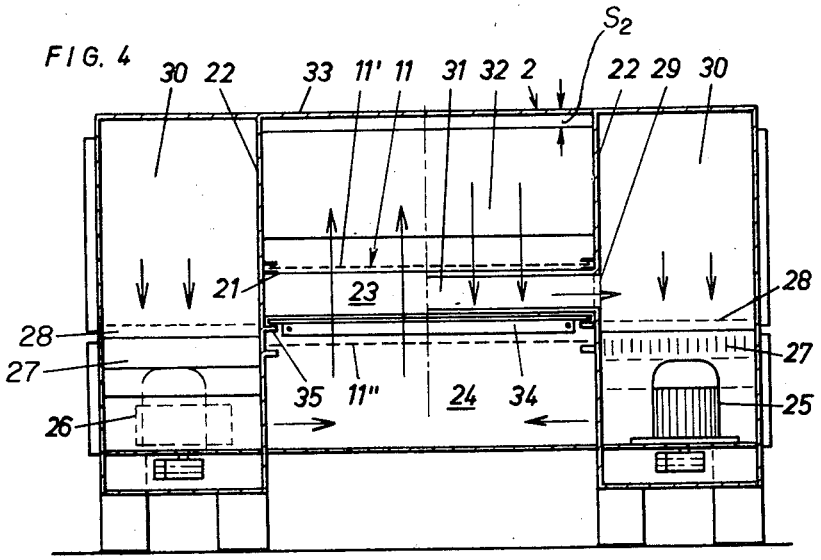
FIG. 4 is a partial longitudinal cross-sectional view taken along line IV—IV in FIG. 2.

To control the intermittent air discharge from the nozzles 23 in the upward direction, slides 34 can be provided. As shown in FIG. 3, the slides 34 are guided closely underneath the nozzles 23 in lateral guides 35 in the longitudinal direction. Suitably, other is closed, respectively, as the slide 34 associated with the nozzles is displaced. All slides 34 are connected by push rods 36. At one end, a connecting rod 37 is articulated to the slide 34, this rod being part of a crank gear 39 driven by a motor 38 (FIG. 1), by means of which all slides 34 are together set into a reciprocating motion. Advantageously, the slides 34 are of such a length that, in the central position, all nozzles 23 are covered up, in order to produce an air pressure head in the pressure chamber 24.

As can be seen most clearly in FIG. 1, the length of material 4 conveyed by the inlet unit 1 is deposited in gathered form on the end of the conveyor belt 11 on the inlet side and thus enters the first treatment unit 2 in a loose and resting condition. As soon as the length of material passes over the nozzles 23, the respective part of the length of material 4 is flung upwardly by the air ejected intermittently and in spurts, and thus the length of material 4 rises as a standing loop 4'into the space between the partitions 32. As soon as the nozzle 23 is closed, the loop 4' collapses. The entire length of material 4 travels on and with the conveyor belt 11 through the treatment unit 2, during which procedure all longitudinal areas in each treatment zone 43 are constantly and repeatedly straightened and buckled by lifting and falling caused by impingement of the jet of air from the nozzles 23. At the material outlet, the length of material 4 forms a hanging loop 4", the lowest point of which lies between the vertically superimposed beams of the light barriers 19 and 20 and controls the motor 15 in the indicated manner upon an alteration of the basic position of FIG. 1. The rollers 16 of the outlet unit 3, driven by the motor 15, convey the length of material 4 under simultaneous spreading by the spreader 17 in the upward direction, where the length of material is fed to a windup means (not shown), a stacking means (not shown), a baling means (not shown), or another storage means (not shown) or a subsequent processing machine (not shown).

In order to enhance the treatment results and/or to attain special effects, a sprayable medium can be applied to the length of material 4. Suitable spraying media are liquid, pulverulent and/or gaseous agents, but particularly steam, in order to render the fiber composite supple. The application of the media can be effected at the inlet unit 1 before the length of material 4 is placed on the conveyor belt 11. For this purpose, a spraying device generally designated by the reference numeral 42 with a housing generally designated by the reference numeral 40 is attached to the inlet unit 1, consisting of two shells 40' and 40", between which the length of material 4 is traveling. In this housing 40, pipes 41 or the like are arranged ejecting the spraying medium, under pressure at the length of material 4. To avoid condensation, the two shells 40' and 40" can be heated. Similar spraying devices generally designated by the reference numeral 42' with pipes 41' can also be provided in the treatment units 2, in order to apply a spraying agent to the moving length of material 4 in the treatment zone 43 and/or to the length of material 4 between the treatment zones 43 where the material is essentially at rest.

Figure 5:
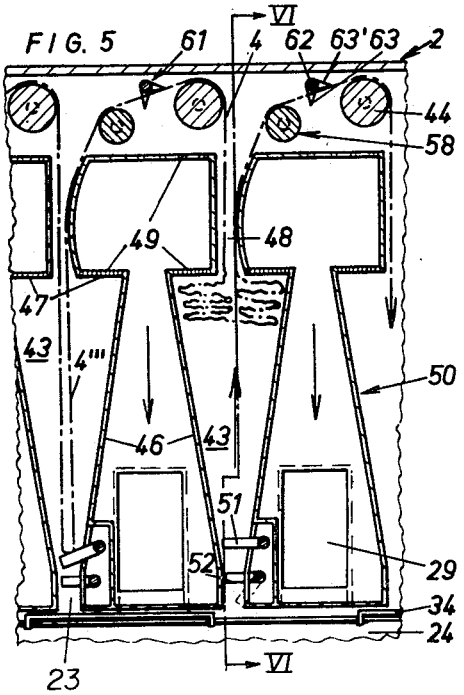
FIG. 5 is a partial longitudinal cross-sectional view of a second embodiment of the present invention.
Figure 6:
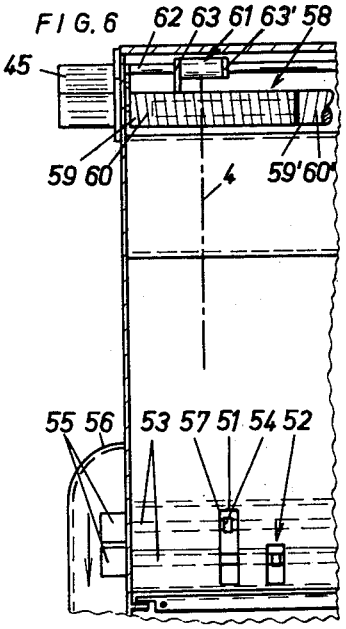
FIG. 6 is a partial cross-sectional view taken along the line VI—VI of FIG. 5.

In a further embodiment of the invention according to FIGS. 5 and 6, the conveying means can also consist of rollers 44 arranged in the upper region of the treatment unit 2 which rollers are driven by laterally mounted motors 45 (FIG. 6) with the length of material 4 being placed over these rollers 44 being such that suspended loop 4''' are produced to gather the material between the rollers 44 in the treatment zones 43. The treatment zones 43 are limited in the conveying direction by upwardly diverging partitions 46 forming at a spacing below the rollers 44 an inwardly directed step 47, whereby a relatively narrow slot 48 is produced for the passage of the entering and leaving length of material 4. The partitions 46 of one treatment zone 43 from the nozzle 23 at the lower end, and the partitions of adjacent treatment zones 43 form a closed housing generally designated by the reference numeral 50, into which air is taken in through apertures 49 in the step 47 and, optionally, through apertures (not shown) provided at the top of the housing 50. The drawn-in air is discharged again through the lateral discharge openings 29 and ducts 56 connected thereto by means of the fan 26. Below the housing 50 is the pressure chamber 24. The intermittent ejection of air from this pressure chamber 24 through the nozzles 23 into the treatment zone 43 again takes place through slides 34 or similar control devices.

It can be seen that each air jet lifts the loop 4''' so that it contacts the step 47 from below, whereby the loop is buckled, whereafter it falls back into its straight position upon the termination of the air jet. The length of the loop 4''' is constantly controlled by feelers 51 and 52 within or closely above the nozzle 23. As soon as only the upper feeler 51 is affected, as illustrated, the normal length has been reached. In contrast thereto, if also the lower feeler 52 is pivoted into the position indicated in dot-dash lines, the loop 4''' is too long, and the speed of the motor 45 of the roller 44 taking off the length of material is accelerated in its rate of revolutions. In contrast thereto, if the upper feeler 51 also remains in the rest condition, then this motor 45 is reduced in its speed. As shown in FIG. 6, the feelers 51 and 52 may be formed as as mechanical devices with fingers 54 attached to shafts 53 and extending through slots 57 in the partitions 46 into the path of movement of the loop 4'''. The shafts 53 are supported on both sides and actuate switching means 55 connected to the motor 45. Of course, this mechanical device can be replaced by optical, pneumatic, or similar means.

In order to guide the length of material 4 fully spread in its width over the rollers 44, a width-spreading roller generally designated by the reference numeral 58 is connected in front of each of the rollers 44. The width-spreading roller 58 can consist, for example, two coaxial half rollers 59 and 59' with oppositely oriented helical threads 60 and 60' (FIG. 6) with each half rollers 59 and 59' drivable individually so that the length of material 4 is spread in its width, but in case of an eccentric extension of the length of material 4, the length of material 4 is centered again by increasing the drive of the half roller 59 or 59' lying in opposition to the lateral displacement. In order to scan central position of the length of material 4, there is provided one feeler device 61 is arranged on the right-hand side and on the left-hand side on the edge of the length of material 4. The feeler device 61 includes a pair of feelers 63 and 63', mounted, for example, to a shaft 62. In the normal position of the length of material 4, the respective inner feeler 63' is held in a pivoted position by the length of material 4, whereas the outer feeler 63 remains in an unaffected position. If the outer feeler 63 is likewise pivoted, then the half roller lying on the other side, for example 60°, is driven to an increased extent. In constrast thereto, if the inner feeler 63' assumes its unaffected position due to a shift of the length of material 4 toward the inside, then the half roller 59 of the same side receives the command to rotate to an increased extent. In order to effect an adjustment to the respective width of the length of material 4, the two feeler pairs 63 and 63' of each feeler device 61 can be adjustable with respect to each other.

It is furthermore possible to utilize, in place of the slides 34 for the intermittent control of the air ejection through the nozzles 23, different means, e.g. flaps, rotary slides, or also pivotable nozzles ejecting the air into the associated treatment zone 43 only within a specific pivotal range. In this connection, the arrangement can also be such that a pivoting nozzle acts on several treatment zones 43 in succession, especially on two neighboring ones in the respective dead center position.

Figure 8:
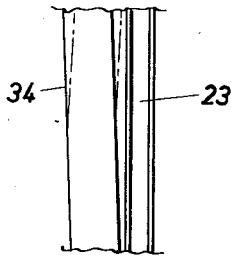
FIG. 8 is a plan view of a modified slide construction for controlling the discharge of the nozzle in accordance with the present invention.

In a further embodiment of the invention, as shown in FIG. 8, the respective edge of the shutting-off means for the opening and/or closing of the nozzle 23 can extend obliquely so that an additional transverse orientation of the length of material 4 to be lifted is attained. Preferably, the oblique positions of the edges of neighboring nozzles 23 are disposed in opposition to each other and/or are of a slightly wedge-shaped configuration, as indicated in dot-dash lines.

Figure 7:
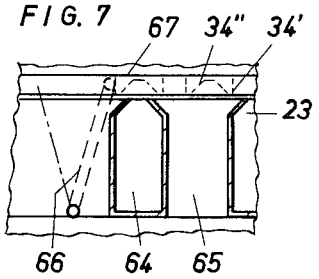
FIG. 7 is a partial cross-sectional view of a nozzle construction in accordance with the present invention.

According to FIG. 7, the nozzles 23 are arranged in the ceiling of a pressure duct 64 which extends transversely through the machine, with the pressure duct 64 being supplied with compressed air via a longitudinal duct 65 in communication with the fan 26. The slide 34 consists of a downwardly concave profile 34' which is moved over the nozzle 23 with several slides 34' being joined together by longitudinal profile elements 67. The longitudinal profile elements 67 are carried by fixedly articulated guide elements 66 so that profile elements 67 execute a slightly swinging reciprocating movement.

Figure 9:
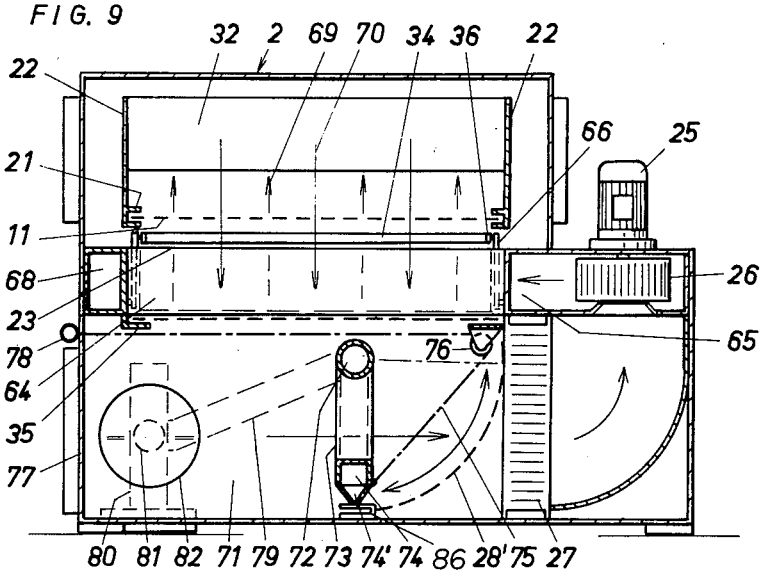
FIG. 9 is a cross-sectional view of a further embodiment in accordance with the present invention.

FIG. 9 provides an example of a treatment unit 2 equipped with the slide 34' in accordance with FIG. 7. The fan 26, driven by the motor 25, forces compressed air into the pressure ducts 64 via the longitudinal duct 65 with the air exiting from the pressure ducts 64 upwardly in jets in the direction of arrow 69 with the amount of air depending upon the degree of passage provided by the slide 34. For pressure equalization, the pressure ducts 64 are in communication with one another at the other end via a compensating duct 68. The air flows in the direction of the arrow 70 after pressure reduction in the treatment zone 43 between the pressure ducts 64, downwardly into a suction chamber 71 and from there through the lint screen 28 and the heat exchanger 27 back to the fan 26. The lint screen 28 constitutes part of a cylindrical surface, in the axis of which a central pipe 72 is rotatably disposed. Two downwardly extending feed conduits 73 are connected to the central pipe 72 and are joined together at the lower end by a nozzle pipe 74 lying in parallel to the central pipe 72. The nozzle pipe 74 extends over the length of the lint screen 28 and is guided along above the lint screen 28 with its nozzle slot 74' at a minor spacing therefrom. For this purpose, a tackle 75 is provided which is guided by a roller 76 arranged closely in front of the heat exchanger 27 and is passed through an opening in the opposite wall 77 where a handle 78 is attached on the outside. If the handle 78 is pulled, the nozzle pipe 74 swivels upwardly in the counterclockwise direction into the final position shown in dot-dash lines. Since simultaneously air is sucked out of the central pipe 72 and thus also from the nozzle pipe 74, the lint resting on the lint screen 28 is lifted by the vaccum present at the nozzle slot 74' and is conveyed to the outside. The central pipe 72 extends through the end wall of the treatment unit 2 and is connected on the outside to the pipeline 79 in communication with a suction fan 80. The delivery pipe 81 of the suction fan 80 extends into the suction chamber 71 where a lint bag 82 is detachably fastened. In the position illustrated in FIG. 9, the nozzle pipe 74 is in a rest position with a sealing lip 86 arranged closely underneath the nozzle slot 74'so as to contact the nozzle slot 74' from the outside thereof and thus preventing the efflux of bypass air.

Figure 10:
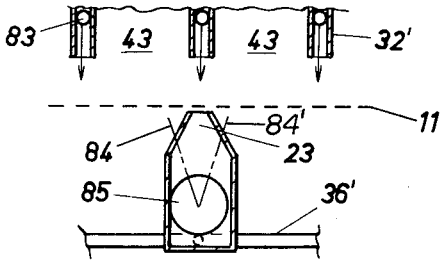
FIG. 10 is a partial cross-sectional view of another embodiment in accordance with the present invention.

According to FIG. 10, the partitions 32 are fashioned as a double wall wherein a spray pipe 83 for the spraying of steam or similar substances in the downward direction onto the length of material 4 lying on the conveyor belt 11 is provided. In a further embodiment, the nozzle 23 can be mounted to be pivotable, so that, in the final positions 84, 84' indicated in dot-dash lines, the compressed air is blown into one of the treatment zones 43, thus again lifting the length of material and allowing the latter to fall down again after pivoting into the other final position 84''. For drive purposes, push rods 36' are arranged between nozzles 23' with pipe nipples 85 being arranged at the end face of the respective nozzles 23' to supply compressed air to the nozzles 23' and to serve simultaneously as a bearing for the associated nozzles 23'.

It is also possible in accordance with the present invention to vary the width of the treatment zones 43. By providing walls (not shown) between the conveyor belt 11 and the ceiling 33 with the walls extending in parallel to the sidewalls 22 and over the entire length of the treatment unit 2 closely contacting the partitions 32 in the treatment zone 43. The walls can be fixed in position and/or adjustable by any desired adjusting means, such as, for example, oppositely acting spindles, in order to set the respectively suitable treatment width by a parallel displacement of the walls. By means of one or more of such walls, it is also possible to subdivide several treatment planes in side-by-side relation, so that correspondingly several lengths of material 4 can be treated simultaneously separately from one another. Upon a narrowing of the treatment path, the length of the nozzles 23, which is unnecessary due to the narrowed treatment path, can at the same time be covered by sealing elements preferably connected with the adjustable walls, so that the air exits only along the respectively required treatment width in each treatment zone 43. Finally, the air can also be replaced entirely or partially by one or several gases.

What is claimed is:

1. Process for the continuous, tensionless treatment of textile materials or similar web-shaped flat materials such as drying, shrinking, finishing, or the like, comprising the steps of:

conveying a length of material in gathered form through at least one treatment zone, and intermittently directing at least one jet of a fluid only from below the length of the material so as to straighten and compress the material at the treatment zone by alternatingly lifting the length of material and permitting the same to fall.

2. Process of claim 1, wherein the at least one jet of fluid is intermittently directed at the length of material approximately at a right angle to the conveying direction of the material.

3. Process of claim 2, wherein the length of material conveyed through the treatment zone is constant so as to provide sufficient material to permit lifting of the material by the at least one jet of fluid to a predetermined lifting height.

4. Process of claim 3, further comprising the step of:
applying a sprayable medium to the length of material prior to entrance into the at least one treatment zone.

5. Process of claim 3, further comprising the step of:
applying a sprayable medium to the length of material within the at least one treatment zone.

6. Process of claim 3, wherein a plurality of treatment zones are provided, further comprising the step of:
applying a sprayale medium to the length of material between the treatment zones.

7. Process according to claim 3, wherein a plurality of treatment zones are provided, further comprising the step of:
applying a sprayable medium to the length of material prior to entrance into a first of the treatment zones, within at least one of the treatment zones, and between at least two adjacent treatment zones.

8. Process according to claim 1, further comprising the step of:
applying a sprayable medium to the length of material prior to entrance into the at least one treatment zone.

9. Process according to claim 1, further comprising the step of:
applying a sprayable medium to the length of material within the at least one treatment zone.

10. Process according to claim 1, wherein a plurality of treatment zones are provided, further comprising the step of:
applying a sprayable medium to the length of material between the treatment zones.

11. Process according to claim 1, wherein a plurality of treatment zones are provided, further comprising the step of:
applying a sprayable medium to the length of material prior to entrance into a first of the treatment zones, within at least one of the treatment zones, and between at least two adjacent treatment zones.

12. An arrangement for the continuous, tensionless treatment of textile materials or similar web-shaped flat materials, the arrangement comprising:
treatment means for treating the materials including a housing having a plurality of spaced partitions arranged therein so as to define with side walls of the housing at least one treatment zone,
means for conveying a gathered length of material through said treatment means.
means provided at said treatment zone for intermittently directing at least one jet of a fluid only from beneath the length of material in the at least one treatment zone to alternatingly lift the length of material and permit the same to fall.

13. An arrangement according to claim 12, wherein said means for intermittently directing at least one jet of a fluid includes at least one nozzle arranged at the at least one treatment zone so as to extend approximately at a right angle to the conveying direction of the conveying means.

14. An arrangement according to claim 13, further comprising a source of compressed air and means for communicating said source of compressed air with said at least one nozzle.

15. An arrangement for the continuous, tensionless treatment of textile materials or similar web-shaped flat materials, the arrangement comprising:
treatment means for treating materials including a housing, and at least one treatment zone,
means for conveying a gathered length of material through said treatment means,
means provided at said treatment means for intermittently directing at least one jet of a fluid beneath the length of material in the at least one treatment zone to alternatingly lift the length of material and permit the same to fall including at least one nozzle arranged at the at least one treatment zone so as to extend approximately at right angle to the conveying direction of the conveying means, and
a plurality of spaced partitions arranged in said housing above said at least one nozzle so as to define said at least one treatment zone, said partitions being arranged substantially at a right angle to the conveying direction of the material and having a vertical height corresponding to a predetermined lifting height of the material by said at least one jet of fluid.

16. An arrangement according to claim 13, wherein said plurality of partitions define a plurality of adjacent treatment zones, and wherein means are provided for mounting said nozzle at the treatment means so as to alternatingly direct a jet of fluid into adjacent treatment zones.

17. An arrangement for the continuous, tensionless treatment of textile materials or similar web-shaped flat materials, the arrangement comprising:
treatment means for treating the material including at least one treatment zone,
means for conveying a gathered length of material through said treatment means,
means provided at said treatment means for intermittently directing at least one jet of a fluid beneath the length of material in the at least one treatment zone to alternatingly lift the length of material and permit the same to fall including at least one nozzle arranged at the at least one treatment zone so as to extend approximately at a right angle to the conveying direction of the conveying means,
slide means arranged at an opening of the at least one nozzle so as to selectively open and close the nozzle opening, and means for selectively displacing said slide means.

18. An arrangement according to claim 17, wherein said conveying means includes an air-permeable conveyor belt arranged between two spaced belt supporting means so as to define an upper conveyor run and a return run, and wherein said at least one nozzle and said slide means are arranged between the upper run and return run of the conveyor belt.

19. An arrangement according to claim 18, wherein the treatment means includes a plurality of treatment zones, at least one nozzle is arranged at each treatment zone, a common pressure chamber is provided in the treatment means and communicates with each of the nozzles, and wherein means are provided for supplying a fluid to the pressure chamber and the nozzles.

20. An arrangement according to claim 19, wherein said means for supplying a fluid includes fan means arranged on both sides of said pressure chamber.

21. An arrangement according to claim 17, wherein said slide means includes a closing edge arranged at least partially obliquely to a longitudinal extension of the nozzle.

22. An arrangement according to claim 17, wherein a plurality of treatment zones and a plurality of nozzles are provided, and wherein a slide means is provided for selectively opening and closing adjacent nozzles, said slide means including closing edges cooperable with the respective openings of the adjacent nozzles, said closing edges being obliquely oriented in opposite directions.

23. An arrangement according to claim 13, wherein a plurality of treatment zones are provided, a pivot means is provided for pivotally mounting at least one nozzle between adjacent treatment zones for a movement within a specific pivotal range which range includes a dead center position, and wherein the nozzle associated with adjacent treatment zones alternatingly directs a jet of fluid in the associated treatment zones in a region of the dead center positions of the nozzles.

24. An arrangement according to claim 13, wherein said conveying means includes a plurality of spaced driven roller means arranged in the treatment means above said means for intermittently directing at least one jet of a fluid, and wherein a width-spreading means is arranged in front of each of said roller means as viewed in the conveying direction for spreading the material, the material extending from one roller means, adjacent width-spreading means and adjacent roller means so as to form a loop of material between adjacent roller means.

25. An arrangement according to claim 24, wherein the plurality of spaced partitions define a plurality of adjacent treatment zones between adjacent partitions, the partitions of adjacent treatment zones forming a closed housing, means are provided in an upper zone of said closed housing for communicating with said means for intermittently directing at least one jet of a fluid, and wherein means are provided in a lower region of said closed housing for communicating said closed housing with an intake side of a fan means.

26. An arrangement according to claim 25, wherein means are provided at a lower end of said closed housing for determining and controlling a length of a loop of material.

27. An arrangement according to claim 26, wherein said determining and controlling means includes spaced feeler means for scanning the length of the loop of material and controlling a drive of the roller means so as to maintain a predetermined length of the loop of material.

28. An arrangement according to claim 26, wherein the housing includes spaced sidewalls, and wherein at least one wall means is arranged in the housing of the treatment means parallel to the sidewalls over a length of the treatment means in contact with the partitions for varying the width of the at least one treatment zone.

29. An arrangement according to claim 28, wherein means are provided for selectively displacing said wall means parallel to the sidewalls, and means for intermittently directing a jet of fluid includes at least one nozzle associated with a respective treatment zone, and means operatively associated with the wall means for selectively opening and closing the nozzles in response to a displacement of the wall means so as to alternatingly direct a jet of fluid to the treatment zones.

30. An arrangement according to claim 17, wherein said slide means is fashioned as a profile element, guide means are arranged essentially at a right angle to the conveying direction of the material and pivotally connected to the profile element for guiding the movement thereof, and wherein said profile element is provided with a concave surface portion for cooperation with the nozzle to close the same.

31. An arrangement according to claim 13, wherein said means for intermittently directing a jet of a fluid includes at least one nozzle associated with at least one treatment zone, said at least one nozzle being arranged at a pressure duct, a suction chamber means is arranged beneath the pressure duct, a lint screen including a cylindrical surface is arranged in said suction chamber, a fan means is provided for drawing air from said suction chamber through said lint screen and wherein means are arranged in said suction chamber for selectively cleaning said lint screen.

32. An arrangement according to claim 31, wherein said cleaning means includes a nozzle pipe having a nozzle slot, means for mounting said nozzle pipe in the suction chamber so as to be pivotable about the axis of the cylindrical surface of the lint screen, a suction fan, and means for operatively connecting said suction fan with said nozzle pipe.

33. An arrangement according to claim 32, wherein said means for operatively connecting said suction fan with said nozzle pipe includes a central pipe pivotably arranged along the axis of the cylindrical surface of the lint screen communicating with the suction fan, and hollow feed conduits for communicating the central pipe with said nozzle pipe.

34. An arrangement according to claim 33, wherein sealing means are provided in said suction chamber for sealing the nozzle slot of said nozzle pipe when said nozzle pipe is in a rest position.

35. An arrangement for the continuous, tensionless treatment of textile materials or similar web-shaped flat material, the arrangement comprising:

a treatment means for treating materials including a plurality of treatment zones, means for conveying a gathered length of material through said treatment means, means provided at said treatment means for intermittently directing at least one jet of a fluid beneath the length of material in each of the treatment zones to alternatingly lift the length of material and permit the same to fall including at leat one nozzle associated with each of said treatment zones, and a plurality of slide means arranged at openings of the nozzles so as to selectively open and closed the nozzle openings, means for connecting said slide means to each other, and a common motor operatively connected with said connecting means so as to cause selective displacement of all of said slide means.

36. An arrangement according to claim 13, wherein said conveying means includes an air-permeable conveyor belt arranged between two spaced belt supporting means so as to define an upper conveyor run and a return conveyor run, and wherein said at least one nozzle is arranged between the upper run and return run of the of the conveyor belt.

37. An arrangement according to claim 13, wherein the treatment means includes a plurality of treatment zones, at least one nozzle is arranged at each treatment zone, a common pressure chamber is provided in the treatment means and communicates with each of the nozzles, and wherein means are provided for supplying a fluid to the pressure chamber and nozzles.

38. An arrangement for the continuous tensionless treatment of textile materials or similar web-shaped flat materials, the arrangement comprising:

treatment means for treating materials including a housing having spaced sidewalls, and spaced partitions arranged between the sidewalls so as to define at least one treatment zone, at least one wall means arranged in the housing of the treatment means parallel to the sidewalls over the length of the treatment means in contact with the partitions for varying the width of the treatment zones, means for conveying a gathered length of material through said treatment means, means provided at said treatment means for intermittently directing at least one jet of a fluid beneath the length of material in the at least one treatment zone to alternatingly lift the length of material and permit the same to fall, including at least one nozzle arranged at the at least one treatment zone so as to extend approximately at a right angle to the conveying direction of the conveying means.

* * * * *